United States Patent [19]

Lynch

[11] Patent Number: 4,655,339

[45] Date of Patent: Apr. 7, 1987

[54] CONVEYANCE AND GROUPING OF STRINGED TAGS

[75] Inventor: Steven J. Lynch, Milford, Mass.

[73] Assignee: Dennison Manufacturing Company, Framingham, Mass.

[21] Appl. No.: 685,925

[22] Filed: Dec. 24, 1984

[51] Int. Cl.[4] ..... B65G 47/26

[52] U.S. Cl. ..... 198/836; 198/859

[58] Field of Search ..... 198/644, 477, 678, 425, 198/836, 424, 725, 816, 859

[56] References Cited

U.S. PATENT DOCUMENTS

| | | | |
|---|---|---|---|
| 3,722,661 | 3/1973 | Williams | 198/859 X |
| 3,870,139 | 3/1975 | Wagner | 198/425 X |
| 3,913,727 | 10/1975 | Gruodis | 198/816 |
| 3,931,879 | 1/1976 | Javerzat et al. | 198/425 X |
| 4,024,945 | 5/1977 | Mugishima | 198/424 |
| 4,163,491 | 8/1979 | Rock et al. | 198/836 |
| 4,183,518 | 1/1980 | Brockmuller et al. | 198/425 X |
| 4,341,334 | 7/1982 | Bier | 198/425 X |

*Primary Examiner*—Robert J. Spar
*Assistant Examiner*—D. Glenn Dayoan
*Attorney, Agent, or Firm*—Gary S. Winer

[57] ABSTRACT

A conveyor for conveying and grouping stringed tags. The conveyor carries stringed tags away from a production unit. A counter monitors the number of stringed tags delivered to the conveyor. After a predetermined number of strings have been delivered, the counter sends a signal to the conveyor drive assembly. The conveyor speed is briefly increased to separate the stringed tags into discrete groups. A second conveyor is provided moving in synchrony with the first conveyor for collecting the groups in containers.

5 Claims, 4 Drawing Figures

CONVEYANCE AND GROUPING OF STRINGED TAGS

BACKGROUND OF THE INVENTION

This invention relates to the conveyance of stringed tags, and more particularly to the alignment of stringed tags into discrete groups.

Stringed tags are produced by mechanical equipment, such as the Graeber Inc. Whirlwind 185 Knotter. These machines insert a string through an aperture in a tag and tie a knot in the string. The result is a tag which may be fastened to various articles such as luggage, storage items, or for sale items.

After the stringed tags are produced, they are mechanically inserted between two fixed plates disposed in close conformity, such that the knot lies on one side of the plates, and the tag on the other. The operator then manually counts the stringed tags and places them in containers for distribution or sale to the user.

Counting of the tags is a time consuming and tedious process. Production speed is limited by the speed at which tags can be counted, and by the number of persons at the counting task. Moreover, the stringed tags must be manually inserted into a container. An additional drawback is that due to the repetitious and tedious nature of counting, miscounts are common.

It is therefore an object of the present invention to provide for the mechanical conveyance of stringed tags away from the tag production unit.

It is an additional object of the invention to separate mechanically counted stringed tags into visually distinct groups.

Still another object of the invention is to provide for removal of a bunched group of stringed tags by an operator.

It is a further object of the invention to provide for mechanically placing predetermined numbers of stringed tags into containers.

SUMMARY OF THE INVENTION

In accomplishing the foregoing and related objects, the invention provides for conveyance and grouping of stringed tags. An assemblage of spring loaded plates maintain stringed tags upon a conveyor belt as the latter is driven by a two speed drive assembly.

In accordance with one aspect of the invention, a conveyor belt of extensible material is supported by a base provided with a conforming groove. Stringed tags rest over the belt with the string frictionally adhered to the belt.

In accordance with another aspect of the invention, a hold-down asembly is provided which includes a support attached to the base, and a plurality of rectangular retaining plates coupled to the support, vertically disposed above the belt. Springs urge the retaining plate downwards against a stop. The height of the plates can be adjusted for varying string thicknesses. The plates slideably confront the strings gently maintaining same upon the moving belt.

In accordance with a further aspect of the invention, the plates can be lifted away from the belt to permit removal of the stringed tags.

In accordance with an additional aspect of the invention, the belt proceeds at a first speed which aligns the stringed tags at a uniform close pitch relative to each other. At predetermined intervals, the belt proceeds for a predetermined period of time at an increased speed relative to the first speed to produce a distinct gap between groups of stringed tags.

In accordance with another aspect of the invention, a drive assembly is provided alternately operable at two speeds. A motor drives an assemblage of pulleys coupled to the belt. A counter monitors the number of stringed tags delivered to the conveyor.

In accordance with an additional aspect of the invention, a motor is coupled to an overrunning clutch. A conveyor drive sprocket is coupled to the clutch output. An advance assembly periodically rotates the clutch output at a greater speed than the motor rotates the clutch input.

In accordance with a further aspect of the invention, the advance assembly includes a rack gear driven by an air cylinder. The rack gear mates with the input of a second overrunning clutch, the output of which is coupled to the output of the first overrunning clutch. In this manner, the rack can be driven in a first direction to overspeed the drive sprocket, and can be driven in a second direction to complete a cycle. The second overrunning clutch prevents interference with the rotation of the drive sprocket as the rack is driven in the second direction.

In accordance with an additional aspect of the invention, a second conveyor carrying containers passes the end of the belt. The movement of the second conveyor is synchronized with the belt to receive an assemblage of grouped tags in each container.

In accordance with yet another aspect of the invention, other items are conveyed and grouped by the apparatus of the present invention.

BRIEF DESCRIPTION OF THE DRAWINGS

Other aspects of the invention will become apparent after considering several illustrative embodiments taken in conjunction with the drawings in which.

DETAILED DESCRIPTION OF THE INVENTION

With reference to FIGS. 1–4, the apparatus 10 of the present invention provides a conveyor assembly 100 having a hold-down assembly 200 and a two speed drive assembly 300.

CONVEYOR ASSEMBLY

Figure 1:
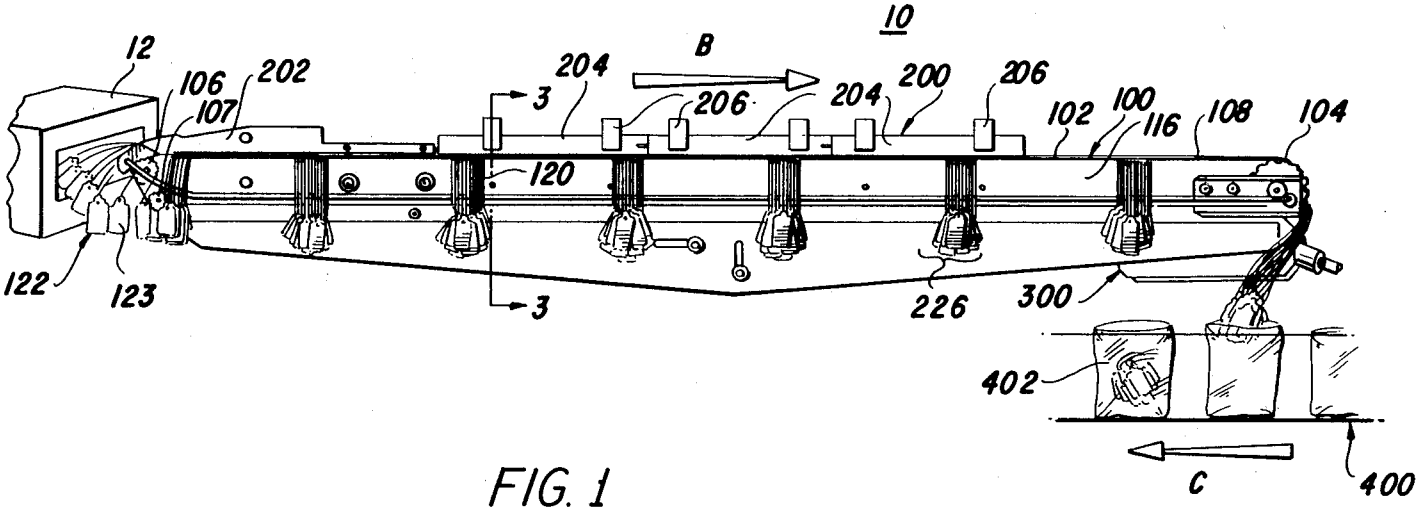
FIG. 1 is a perspective view of an apparatus in accordance with the present invention as seen from the front.
Figure 2:
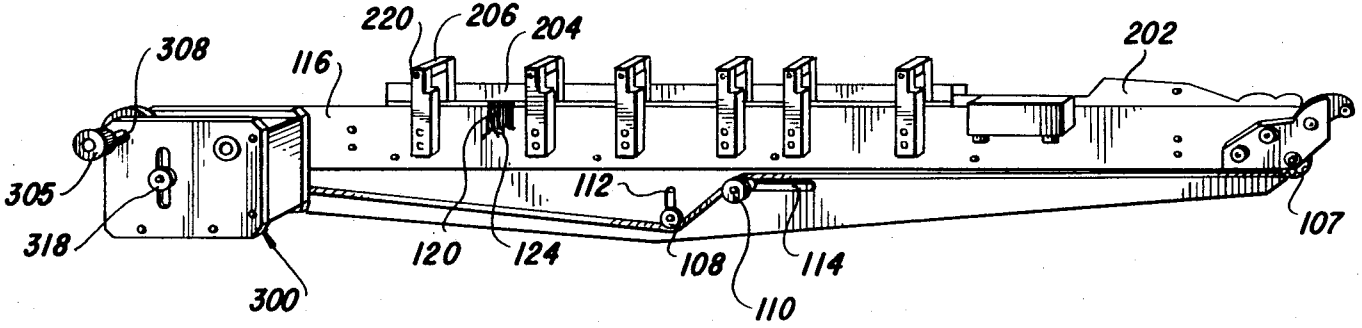
FIG. 2 is a perspective view of the apparatus of FIG. 1 as seen from the back.

The conveyor belt 102 is an endless loop of elongated extensible material, preferably with a nonslip surface such as rubber. In a preferred embodiment, as can be seen in FIGS. 1 and 2, the conveyor belt passes around a drive pulley 104, end pulley 106, and idler pulley 107. Additional tensioner pulleys 108 and 110 may be provided disposed in elongated slots 112 and 114. Belt 102 may be adjustably tightened by moving one or both of pulleys 108, 110 within slots 112, 114 to create the desired tension in belt 102.

The conveyor belt 102 is longitudinally supported in a groove 115 formed in a base 116, which maintains belt 102 in close abutting conformity to hold-down means 200. Base 116 additionally serves as an attachment member for drive assembly 300 and hold-down assembly 200.

HOLD-DOWN ASSEMBLY

Figure 3:
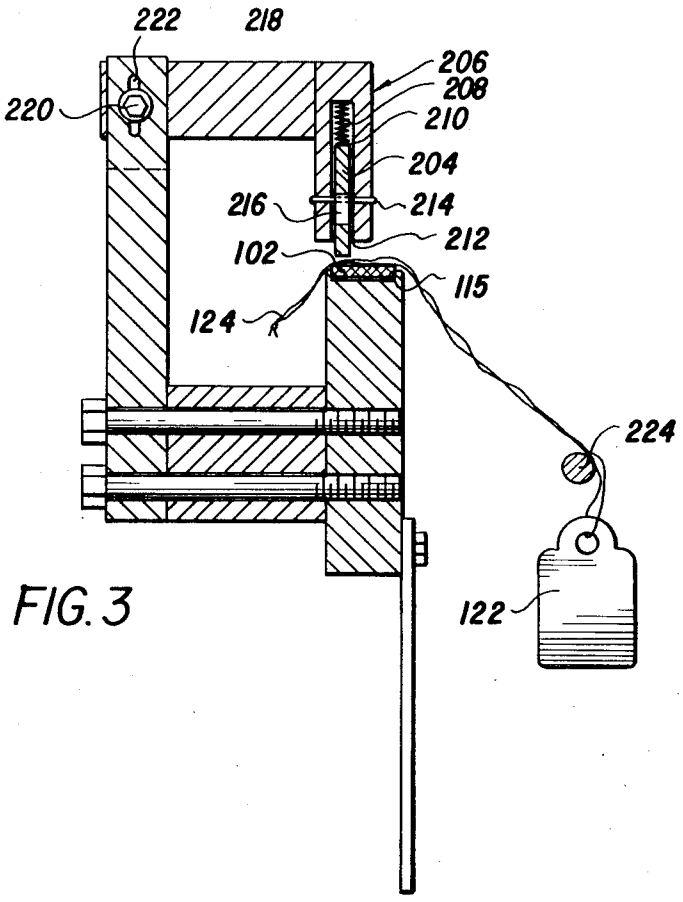
FIG. 3 is a sectional view of the apparatus of FIG. 1 taken along line 3—3.

As shown in FIG. 3, hold-down assembly 200 includes a receiving plate 202 shaped to urge incoming stringed tags 122 downwards onto belt 102. Retaining plates 204 are positioned vertically above belt 102 in close abutting proximity therewith by supports 206. Strings 120 lay across belt 102, with the tag portion 123 suspended on the front side, as shown in FIG. 1. Strings 120 are maintained upon belt 102 by gravity and friction, gently urged against belt 102 by retaining plates 204. In the event that a string should slip, knot 124 will be intercepted by retaining plate 204, preventing the tag 122 from falling off belt 102.

Retaining plates 204 may be raised upwardly to permit the removal of strings. As shown in FIG. 3, a spring 208 is disposed within each support 206 confronting the upper surface 210 of retaining plate 204. A slot 212 disposed within support 206 confines retaining plate 204 to an upwards or downwards movement. Retaining plate 204 is limited in length of travel by pin 214 which passes through support 206, and slot 216 disposed within retaining plate 204. To temporarily increase the gap between retaining plate 204 and belt 102, retaining plate 204 is lifted upwards against the force of spring 208. After the strings are removed, spring 208 urges retaining plates downward into correct conformity, as defined by the stop created by pin 214 and slot 216. Retaining plate 204 may be adjustably aligned by moving the upper support 218 as permitted by bolt 220 and slot 222. Tags 122 are held outwards with respect to base 116 by a guide rail 224 which runs longitudinally along base 116. In this manner, an operator's fingers can pass behind the strings 120 to collect an assemblage of grouped stringed tags 226.

DRIVE ASSEMBLY

Figure 4:
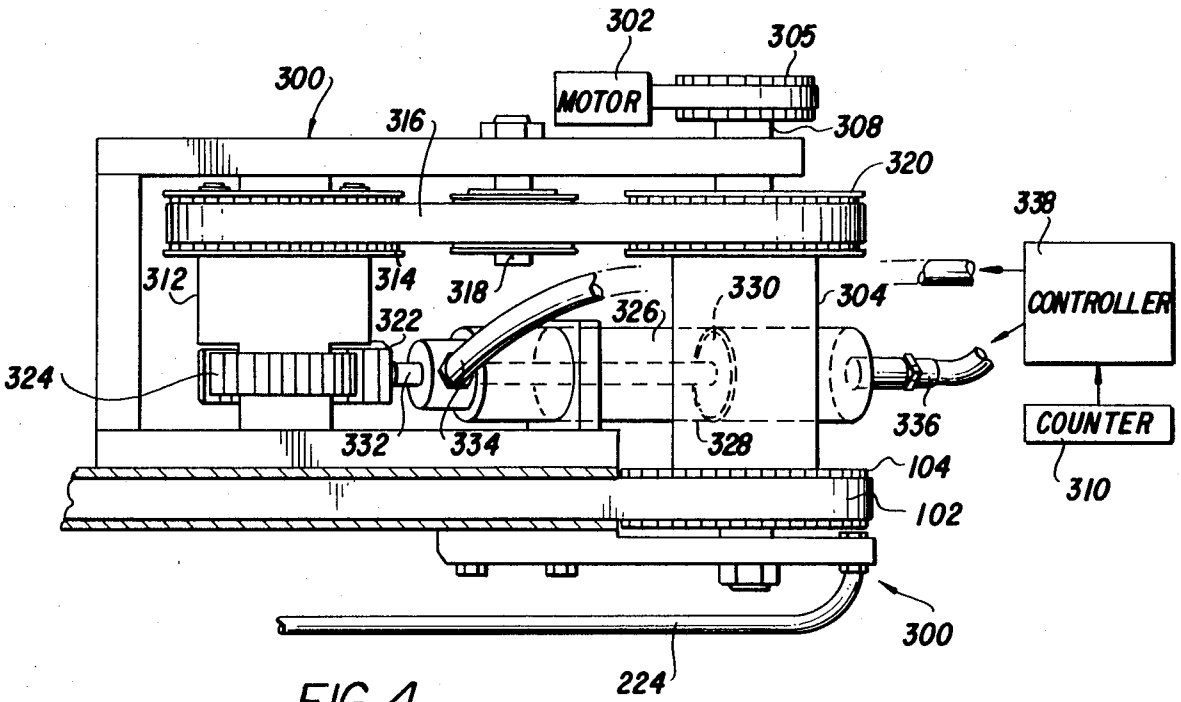
FIG. 4 is a plan view of a drive assembly in accordance with the present invention.

With reference now to FIG. 4, drive assembly 300 includes a motor 302, an overrunning clutch 304, a drive pulley 104, and an advance assembly 306.

Motor 302 continuously rotates the input of overrunning clutch 304 via pulley 305 and shaft 308. Drive pulley 104 coupled to clutch 304 output, is thus caused to rotate. Advance assembly 306 is also coupled to clutch 304 output. A counter 310 monitors the number of strings produced by tag production unit 12. Upon a signal from counter 310, advance assembly causes the rotation of clutch 304 output at a greater speed than clutch 304 input. Clutch 304 provides engaging rotation when the input is driven in one direction and disengagement when either the input is driven in the opposite direction, or when the output is rotated faster than the input. Thus, the speed of drive pulley 104 is increased without resistance from, or damage to, the motor.

Overspeed of drive pulley 104 may be accomplished in a variety of ways. It is possible, for example, to use a second motor to periodically rotate clutch 304 output at a greater speed than clutch 304 input. Advance assembly 306, however, provides a simple, effective, and cost efficient method of achieving this overspeed.

A second overrunning clutch 312 has an output coupled to the output of clutch 304, via pulley 314, belt 316, tensioner 318, and pulley 320. A rack gear 322 is coupled to clutch 312 input via spur gear 324. Drive pulley 104 is oversped by driving rack gear 322 against spur gear 324, thus rotating clutch 312, 304 outputs respectively. When rack gear has reached the end of its stroke, it must be driven in an opposite direction to complete the rack cycle, resetting for the next advance. Clutch 312 enables rack gear 322 to be driven back without causing rotation to clutch 312 and clutch 304 outputs. Further, clutch 312 output may continue to rotate via attachment to clutch 304 output, during the time period when rack gear 322 is motionless.

A variety of means may be employed to drive rack gear 322. A simple and effective means, in a preferred embodiment, includes an air cylinder 326. Air cylinder 326 comprises cylinder 328, piston 330, shaft 332, and input ports 334 and 336. Shaft 332 is coupled to rack gear 322. As high pressure fluid enters port 336, rack gear 322 rotates clutch 312 input, thus rotating drive sprocket 104. As high pressure fluid enters port 334, clutch 312 input is rotated without rotating clutch 312 output.

OPERATION

The apparatus 10 operation in a preferred embodiment includes mounting the apparatus 10 proximate the outlet of a tag production unit 12. Known tag production units, such as the Graeber Inc. Whirlwind 185 Knotter provide an arm which pushes the string 120 within an opening between two plates. Receiving plate 202 and base 116 replace these plates and guide the stringed tags 122 onto belt 102. Motor 302 operates continuously driving belt 102 at a first predetermined speed which disposes stringed tags 122 in close conformity upon belt 102.

A counter 310 monitors the number of tags delivered to apparatus 10. Upon reaching a designated number of tags delivered, the counter 330 signals a high pressure fluid controller 338, which causes high pressure fluid, such as air, to enter port 336. Counter 310 may deliver an electrical or mechnical signal to controller 338, depending on the type of prior art pressure controller used. Controller 338 can be of the relay logic or programmable type, the Texas Instrument TI510 being an example of the latter. As described above, rack gear 322 is driven against spur gear 324 causing an accellerated rotation of drive sprocket 104. As a result, a space is created on belt 102 between the last tag delivered and the next incoming tag. Controller 338 then causes high pressure fluid to enter port 334, resetting rack gear 322 for the next cycle. Consequently, a plurality of assemblages of grouped stringed tags 226 results upon belt 102, wherein groups of stringed tags 226 are separated by a clearly visible gap. An operator can bunch together a group 226 and remove them for packaging by raising retaining plate 204, or by sliding the bunch along belt 102 until clear of all retaining plates.

In an alternative embodiment shown in FIG. 1, a second conveyor assembly 400 passes proximate drive pulley 104 carrying containers 402. The opening of container 402 is large enough to accommodate a complete group of stringed tags 226 as same falls off the end of apparatus 10. The movement of conveyor assembly 400 is synchronized with counter 330 so that an empty container is in position to receive an entire group 226.

The present invention may additionally be used to group and count other items. Belt 102 can support a wide variety of objects which can be separated into groups in the aforedescribed manner. Where the objects fit securely upon the surface of belt 102, hold-down assembly 200 may be removed.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

What is claimed is:

1. Apparatus for grouping strings comprising:
a counter;
drive means responsive to said counter;
an endless conveyor belt responsive to said drive means;
means for maintaining said strings upon said conveyor;
wherein said counter causes said drive means to increase speed at predetermined intervals for a predetermined length of time to separate counted groups of items upon said conveyor; said drive means comprising a first overrunning clutch having an input and an output, a motor coupled to the input of said first overrunning clutch, a drive pulley coupled to the output of said first overrunning clutch operative to move said conveyor, advance means coupled to the output of said first overrunning clutch;
wherein said motor continuously rotates the input of said first overrunning clutch to drive said conveyor;
said advance means periodically rotates the output of said first overrunning clutch at a greater speed then the motor rotates the input of said first overrunning clutch, thereby periodically increasing the speed of said conveyor;
said advance means comprising a rack gear drive, a rack gear responsive to said rack gear drive, a second overrunning clutch having an input mateable with said rack gear and an output coupled to the output of said first overrunning clutch;
wherein said rack gear is driven in a first direction causing the increase in speed of said conveyor, then driven in a second direction in preparation for the next cycle;
whereby the rotation of the output of said second overrunning clutch is not affected by the rotation of the input of said second overrunning clutch as said rack is driven in the second direction.

2. The apparatus of claim 1 wherein said rack gear drive comprises:
a source of high pressure fluid;
a high pressure fluid controller responsive to said counter;
an air cylinder responsive to said source of high pressure fluid; and
an air cylinder output shaft coupled to said rack gear.

3. The apparatus of claim 1 wherein the maintaining means comprise:
a conveyor base;
a plurality of support brackets fastened to said base;
at least one elongated narrow bar vertically disposed above said conveyor secured to said plurality of support brackets in a spring loaded manner;
wherein said plurality of elongated narrow bars move upwardly away from said conveyor permitting the removal of a counted group of strings when bunched together.

4. The apparatus of claim 1 further comprising:
a second conveyor;
a plurality of containers disposed upon said second conveyor;
wherein the movement of said second conveyor is synchronized with said first conveyor to receive a counted group of strings per container.

5. The apparatus of claim 1 further comprising:
at least one tightening sprocket disposed in at least one elongated slot;
wherein said tightening sprocket may be moved within said slot to adjustably tighten said conveyor.

* * * * *